US005088212A

United States Patent [19]

Trinkaus et al.

[11] Patent Number: 5,088,212

[45] Date of Patent: Feb. 18, 1992

[54] SKI BOOT HAVING A MOVABLE FRONT FLAP MEMBER UNINHIBITED BY TIGHTENING FORCES

[75] Inventors: Gerhard Trinkaus, Bärnbach; Josef Löcker, Voitsberg, both of Austria

[73] Assignee: Koflach Sport Gesellschaft m.b.H. & Co. KG, Vocklabruck, Austria

[21] Appl. No.: 536,646

[22] PCT Filed: Nov. 16, 1989

[86] PCT No.: PCT/AT89/00103

§ 371 Date: Jul. 6, 1990

§ 102(e) Date: Jul. 6, 1990

[87] PCT Pub. No.: WO90/05465

PCT Pub. Date: May 31, 1990

[30] Foreign Application Priority Data

Nov. 18, 1988 [AT] Austria ..... 2835/88

[51] Int. Cl.[5] ..... A43B 5/04

[52] U.S. Cl. ..... 36/120; 36/54; 36/50; 36/118

[58] Field of Search ..... 36/117-121, 36/50, 53, 54

[56] References Cited

U.S. PATENT DOCUMENTS

| | | | |
|---|---|---|---|
| 3,886,673 | 6/1975 | Check et al. | 36/2.5 AL |
| 4,107,856 | 8/1978 | Bourque | 36/115 |
| 4,282,659 | 8/1981 | Bourque et al. | 36/121 |
| 4,551,933 | 11/1985 | Morell et al. | 36/120 |
| 4,575,957 | 3/1986 | Petrini | 36/121 |
| 4,624,063 | 11/1986 | Delery | 36/117 |
| 4,653,205 | 3/1987 | Koch | 36/117 |

FOREIGN PATENT DOCUMENTS

| | | | |
|---|---|---|---|
| 0172158 | 2/1986 | European Pat. Off. | 36/117 |

*Primary Examiner*—Paul T. Sewell
*Assistant Examiner*—Thomas P. Hilliard
*Attorney, Agent, or Firm*—Nixon & Vanderhye

[57] ABSTRACT

In a ski boot with a rear part (3), which can be bent or folded back, for rear entry, with a lower shell (1) and an upper (4) that can swivel relative to lower shell (1), swivable upper (4) exhibits a flap (5), which runs in the peripheral direction of upper (4) and backward to rear part (3) and is placed overlaping the upper on the outside in a region of upper (4) facing the toe of the boot and lying perpendicular to the longitudinal median plane of the boot, and flap (5) with its free end region can be connected to upper (4) at various vertical positions. In this case, flap (5) on its free end region exhibits a tunnel-shaped protuberance (7), and a fastening element for fastening a strap-shaped tightening element (6) is placed on upper (4) in the region of tunnel-shaped protuberance (7) of flap (5) and the width of tightening element (6) is smaller than the inside width of tunnel-shaped protuberance (7), to be able to fasten flap (5) to upper (4) independently of the closing forces of tightening element (6).

20 Claims, 2 Drawing Sheets

SKI BOOT HAVING A MOVABLE FRONT FLAP MEMBER UNINHIBITED BY TIGHTENING FORCES

Figure 1:
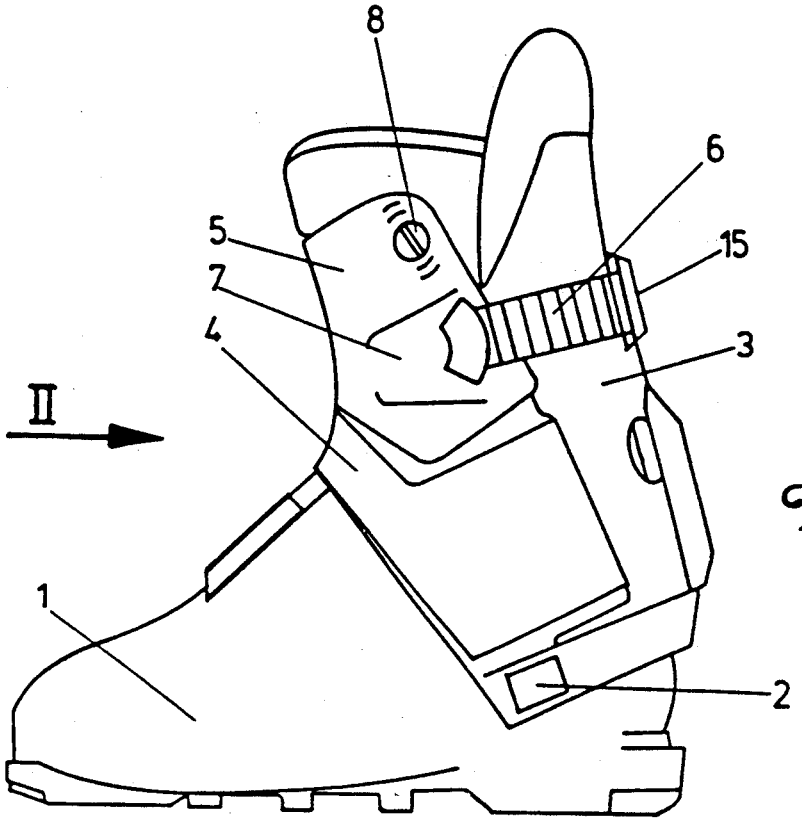

The invention relates to a ski boot with a rear part, which can be bent or folded back, for rear entry, with a lower shell and an upper that can swivel relative to the lower shell, in which the swivable upper exhibits a flap, said flap runs in the peripheral direction of the upper and backward to the rear part and is placed overlapping the upper on the outside in a region of the upper facing the toe of the boot and lying perpendicular to the longitudinal median plane of the boot, and the flap with its free end region can be connected to the upper at various vertical positions.

A ski boot of the initially named type has become known, for example, from EP-A 172 158. In this known ski boot the flap above the instep serves for improving the matching of the boot to the shape of the leg, and the flap, which extends perpendicular to the longitudinal median plane of the boot, can be made one piece with the cuff or upper or can be made as a separate flap. Especially to achieve an inclination of the upper relative to boot longitudinal median plane perpendicular to the sole, it has further become known to design vertically adjustable the pivot points of the upper or cuff on the lower shell. While such an adjustment of the inclination from the longitudinal median plane toward both sides basically changes the damping behavior in a pivoting of the boot in the direction toward the forward lean, by the design of a boot with a flap extending perpendicular to the longitudinal median plane a fitting to the various leg shapes or calf shape as well as an adjustability of the pin of the upper relative to the longitudinal median plane of the ski boot can be attained, without in this case the pivotability in the direction of a forward lean or a backward lean being influenced or adversely affected. Such a flap, extending perpendicular to the longitudinal median plane of the boot especially facilitates a sealing of the boot at its upper edge, without undesirable pressure points on the leg occurring.

The known design according to EP-A 172 158 provided that this flap extending perpendicular to the longitudinal median plane of the boot is tightened by a tightening element toward the rear part that can be folded back. The closing position of the boot, in which the rear part that can be folded back is connected with the flap by the tightening element, in this case depends on the inside diameter of the opening of the boot in the closed state, and this inside diameter of the opening of the boot can be defined by the leg shape and the ski clothing. Depending on the size of the inside width in the closing position different force components are introduced by this tightening element into the closing flap, which can impair a fitting to the leg shape that is exact and free of pressure points.

The object of the invention is to develop a ski boot of the initially mentioned type in such a way that the fitting of the leg shape can be kept independent of the closing position and the closing force of the tightening element, which tightens the upper with the rear part that can be folded back. To achieve this object the invention consists essentially in the fact that the flap on its free end region exhibits a tunnel-shaped protuberance, that a fastening element for fastening a strap-shaped tightening element is placed on the upper in the region of the tunnel-shaped protuberance of the flap and that the width of the tightening element is smaller than the inside width of the tunnel-shaped protuberance. Because the flap exhibits a tunnel-shaped protuberance on its free end region, the strap-shaped tightening element can plunge into this tunnel-shaped protuberance and be fastened directly to the upper. The closing forces of this tightening element do not act in this way on the flap, so that the flap can serve exclusively for fitting different leg shapes, without this fitting being distorted by the closing forces.

In this case the design is advantageously made so that the tunnel-shaped protuberance of the flap is designed as an opening of the flap, said opening toward the free end region of the flap is limited by a flange, that the fastening element is placed at a distance from the flange of the flap on the upper and that the tightening element can be guided by the outside of the flange to the fastening element. With such a design, the different angular positions of the tightening element relative to the pin of the upper also in no way act on the fitting properties of the flap, and in addition the advantage is achieved that the flap, at a distance from the point at which it is fastened to the upper vertically adjustable region, again is pressed against the upper, by which a tight connection of the flap on the cuff or upper is assured. The upper or cuff can also exhibit a recess under the flap, as known in the design according to EP-A 172 158, and, of course, the upper designed correspondingly rigid in the region on which the fastening element is placed for fastening the strap-shaped tightening element. The recess in the upper or cuff in these cases can be limited basically to a V-shaped or trapezoidal cutout, whose side edges diverge at the upper edge of the upper so that the fitting properties of the flap can be used especially effectively.

Also in an advantageous way in the design according to the invention tightening of the tightening element is possible in a simple way in that the tightening element can be tightened by a tightening lever in the rear region of the boot or on the side of the upper opposite the fastening element against the rear part that can be folded back. To guarantee, with different widths on the upper edge of the upper, that the adjustment of the flap is not adversely affected in any way it is advantageous that the design be so made that the tunnel-shaped protuberance is limited by side walls, which starting from the free end region of the flap run in a converging manner to the longitudinal median plane of the boot, so that a collision of the strap-shaped tightening element with the side walls of the tunnel-shaped protuberance or hole is definitely avoided. An especially effective and tight fastening of the flap with considerable freedom with reference to fitting on the leg shape can be achieved in that the tunnel-shaped protuberance of the flap is placed under the vertically adjustable connection of the flap with the upper. Such a design is particularly of especial advantage if the tunnel-shaped protuberance is formed by an opening so that under the vertically adjustable fastening of the flap on the upper a renewed pressing of the flap on the upper by the tightening element takes place in closing the tightening element.

The fastening element on the upper can be designed as a toothed clamp in a way known in the art, and considering the tunnel-shaped protuberance and simplification of the handling of such a fastening element the design is advantageously such that the fastening element on the upper is designed as a toothed clamp, whose actuating element projects from the tunnel-shaped protuberance in the direction of the free end region of the flap. By such an actuating element, which projects from the tunnel-shaped protuberance, an entry point into the tunnel-shaped protuberance is largely covered so that penetration of snow into the flap is also largely prevented.

The invention is explained in greater detail below by an embodiment diagrammatically represented in the drawing.

Figure 2:
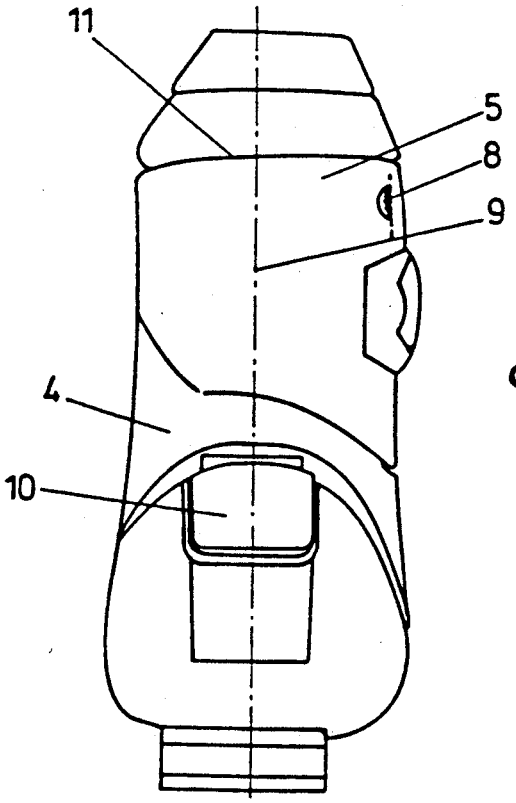
Figure 3:
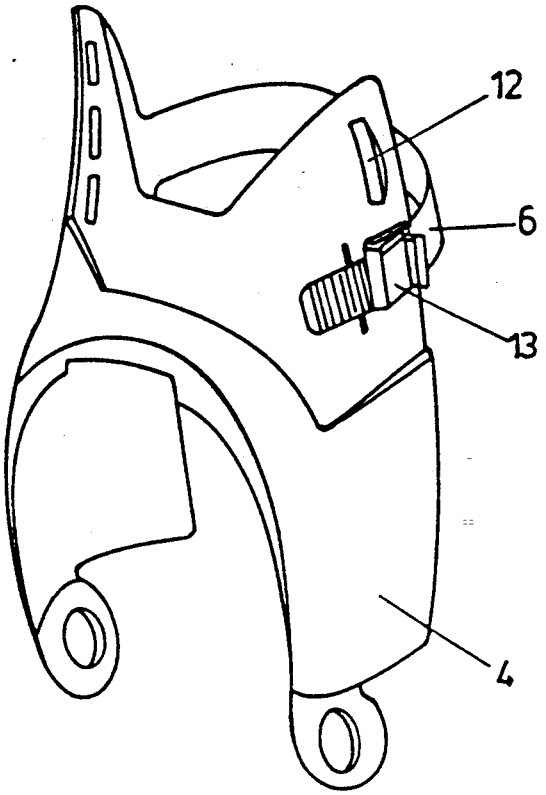
Figure 4:
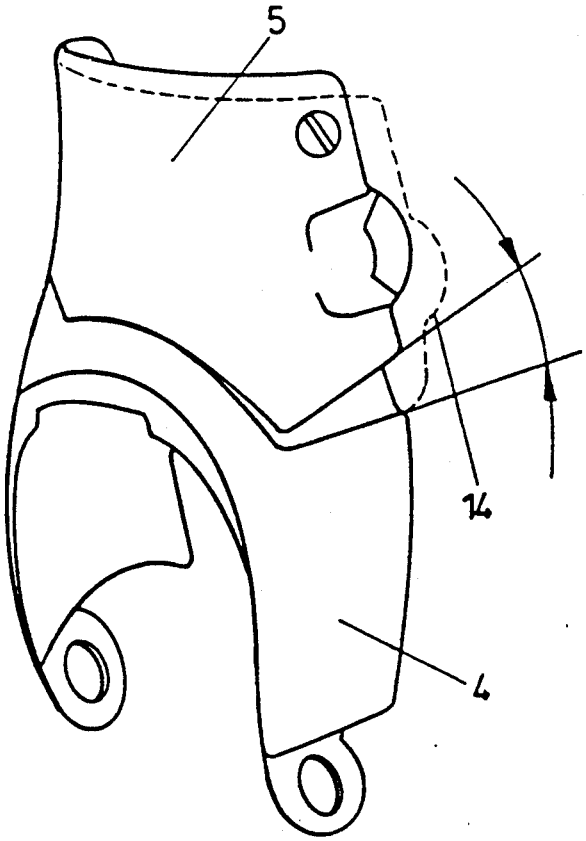

In the drawing there are shown in:

FIG. 1, a side view of a boot according to the invention;

FIG. 2, a view of the boot according to FIG. 1 in the direction of arrow II;

FIG. 3, a perspective view of a cuff or upper with the closing flap removed; and FIG. 4, a view analogous to FIG. 3, with the flap attached but without the tightening element which is represented in FIG. 3.

In FIG. 1 a ski boot shell is identified by 1, on which a rear part 3, pivotable around a pivot pin 2 and able to be folded back, is hinged. A cuff or an upper 4 is hinged to pivot around the same hinge pin 2 in the region above the instep, and in the region of this upper 4 facing the toe of the boot a closing flap 5 extending perpendicular to the longitudinal median plane is provided. Rear part 3, which can be folded back, is tightened by a tightening element 6 with upper 4, and tightening element 6 is plunged into a tunnel-shaped protuberance 7 of flap 5. Flap 5 itself is movable in elevation and can be lockably connected in its vertical position with upper 4, and the device for fastening the flap is formed by a screw 8 movably guided in a slot.

In the representation according to FIG. 2, the longitudinal median plane of the boot is indicated diagrammatically by 9. In this case in the instep region of the boot a fitting device 10, not represented in detail, is diagrammatically indicated for fitting the boot in the forefoot region. Closing flap 5 on upper 4 is again fixed by screw 8 in its vertical position and by fastening of closing flap 5 in different vertical position with screw 8 upper edge 11 of closing flap or flap 5 is better fitted to the respective leg shape and an oblique position of the upper relative to the pin of the upper can be achieved.

The slot for fastening screw 8, which produces the vertically adjustable fastening of flap 5, is identified by 12 in FIG. 3. In the representation according to FIG. 3 flap 5 is removed and it can be seen that tightening element 6 is directly connected to upper 4 by a clamping device 13. The forces of tightening element 6 in this case are not transmitted to flap 5 but directly to pivotable upper 4, so that the relative adjustment of flap 5 by moving of screw 8 in slot 12 and fastening of this screw can be kept independent of the closing forces.

In the representation according to FIG. 4, tightening element 6 is not drawn in. The size of the vertical adjustment of flap 5 for fitting on different leg shapes is indicated by dot-dash contour 14, which corresponds to another position of flap 5 relative to upper 4.

A conventional tightening buckle, which is indicated diagrammatically by 15 in FIG. 1, can be placed in the region of the rear part that can be folded back.

We claim:

1. A ski boot having a toe, a heel, and a median plane, and comprising:

a rear part which can be bent or folded back, for rear entry;

a lower shell;

an upper mounted to said lower shell so that it can swivel with respect to said lower shell;

said upper having a flap running in a peripheral direction of said upper, and backwardly toward said rear part, and having a free end region; said flap for fitting different leg shapes of wearers of the boot;

said rear part overlapping said upper on the outside thereof in a region of said upper facing the toe of the boot and lying perpendicular to the median plane of the boot;

said flap free end region connectable to said upper at various vertical positions;

said flap having a tunnel-shaped protuberance on its free end region, said protuberance having a given inside width and comprising an opening in said flap, opening towards said free end region, and limited by a flange;

a fastening element, and a strap shaped tightening element associated with said upper, said fastening element for fastening said strap shaped element in the region of said tunnel shaped protuberance of said flap; and said strap shaped tightening element having a width which is smaller than the inside width of said tunnel shaped protuberance, so that the tightening forces exerted by said strap shaped tightening element act only on said flange of said flap, allowing said flap to movably adjust for fitting different leg shapes while the leg area adjacent said flap remains substantially free of undesirable pressure from the tightening forces.

2. A ski boot as recited in claim 1 wherein said flange has an inside and an outside; said fastening element disposed at a distance from said flange on said upper; and said strap shaped tightening element guided into operative association with said fastening element by the outside of said flange.

3. A ski boot as recited in claim 1 further comprising a tightening lever in said rear region opposite said fastening element, for tightening said strap shaped tightening element against said rear part.

4. A ski boot as recited in claim 3 wherein said tightening lever is foldable so as to prevent a minimum exposed surface during use of the ski boot.

5. A ski boot as recited in claim 2 further comprising a vertically adjustable connection of said flap with said upper; and wherein said tunnel shaped protuberance of said flap is placed under said vertically adjustable connection of said flap with said upper.

6. A ski boot as recited in claim 3 wherein said fastening element on said upper comprises a toothed clamp having an actuating element which projects from said tunnel shaped protuberance in the direction of said free end region of said flap.

7. A ski boot as recited in claim 1 further comprising a tightening lever in said rear region opposite said fastening element, for tightening said strap shaped tightening element against said rear part.

8. A ski boot as recited in claim 7 wherein said tightening lever is foldable so as to prevent a minimum exposed surface during use of the ski boot.

9. A ski boot as recited in claim 7 further comprising a tightening lever in said rear region opposite said fastening element, for tightening said strap shaped tightening element against said rear part.

10. A ski boot as recited in claim 1 further comprising a vertically adjustable connection of said flap with said upper; and wherein said tunnel shaped protuberance of said flap is placed under said vertically adjustable connection of said flap with said upper.

11. A ski boot as recited in claim 1 wherein said fastening element on said upper comprises a toothed clamp having an actuating element which projects from said tunnel shaped protuberance in the direction of said free end region of said flap.

12. A ski boot having a toe, a heel, and a longitudinal median plane, and comprising:

a rear part which can be bent or folded back, for rear entry;

a lower shell;

an upper mounted to said lower shell so that it can swivel with respect to said lower shell;

said upper having a flap running in a peripheral direction of said upper, and backwardly toward said rear part, and having a free end region; said flap for fitting different leg shapes of wearers of the boot;

said rear part overlapping said upper on the outside thereof in a region of said upper facing the toe of the boot and lying perpendicular to the median plane of the boot;

said flap free end region connectable to said upper at various vertical positions;

said flap having a tunnel-shaped protuberance on its free end region, said protuberance having a given inside width;

a fastening element, and a strap shaped tightening element associated with said upper, said fastening element for fastening said strap shaped element in the region of said tunnel shaped protuberance of said flap;

said strap shaped tightening element having a width which is smaller than the inside width of said tunnel shaped protuberance; and said tunnel shaped protuberance being limited by side walls which, starting from said free end region of said flap, run in a converging manner towards said longitudinal median plane of the boot.

13. A ski boot as recited in claim 12 further comprising a vertically adjustable connection of said flap with said upper; and wherein said tunnel shaped protuberance of said flap is placed under said vertically adjustable connection of said flap with said upper.

14. A ski boot as recited in claim 13 wherein said fastening element on said upper comprises a toothed clamp having an actuating element which projects from said tunnel shaped protuberance in the direction of said free end region of said flap.

15. A ski boot as recited in claim 12 wherein said fastening element on said upper comprises a toothed clamp having an actuating element which projects from said tunnel shaped protuberance in the direction of said free end region of said flap.

16. A ski boot as recited in claim 12 wherein said tunnel shaped protuberance of said flap comprises an opening in said flap, opening toward said free end region, and limited by a flange, having an inside and an outside; said fastening element disposed at a distance from said flange on said upper; and said strap shaped tightening element guided into operative association with said fastening element by the outside of said flange.

17. A ski boot having a toe, a heel, and a median plane, and comprising:

a rear part which can be bent or folded back, for rear entry;

a lower shell;

an upper mounted to said lower shell so that it can swivel with respect to said lower shell;

said upper having a flap running in a peripheral direction of said upper, and backwardly toward said rear part, and having a free end region; said flap for fitting different leg shapes of wearers of the boot;

said rear part overlapping said upper on the outside thereof in a region of said upper facing the toe of the boot and lying perpendicular to the median plane of the boot;

said flap free end region connectable to said upper at various vertical positions;

said flap having a tunnel-shaped protuberance on its free end region, said protuberance having a given inside width;

a fastening element, and a strap shaped tightening element associated with said upper, said fastening element for fastening said strap shaped element in the region of said tunnel shaped protuberance of said flap; and said strap shaped tightening element having a width which is smaller than the inside with of said tunnel shaped protuberance;

a vertically adjustable connection of said flap with said upper; and wherein said tunnel shaped protuberance of said flap is placed under said vertically adjustable connection of said flap with said upper.

18. A ski boot as recited in claim 17 wherein said fastening element on said upper comprises a toothed clamp having an actuating element which projects from said tunnel shaped protuberance in the direction of said free end region of said flap.

19. A ski boot having a toe, a heel, and a longitudinal median plane, and comprising:

a rear part which can be bent or folded back, for rear entry;

a lower shell;

an upper mounted to said lower shell so that it can swivel with respect to said lower shell;

said upper having a flap running in a peripheral direction of said upper, and backwardly toward said rear part, and having a free end region; said flap for fitting different leg shapes of wearers of the boot;

said rear part overlapping said upper on the outside thereof in a region of said upper facing the toe of the boot and lying perpendicular to the median plane of the boot;

said flap free end region connectable to said upper at various vertical positions;

said flap having a tunnel-shaped protuberance on its free end region, said protuberance having a given inside width;

a fastening element, and a strap shaped tightening element associated with said upper, said fastening element for fastening said strap shaped element in the region of said tunnel shaped protuberance of said flap;

said strap shaped tightening element having a width which is smaller than the inside width of said tunnel shaped protuberance; and wherein said fastening element on said upper comprises a toothed clamp having an actuating element which projects from said tunnel shaped protuberance in the direction of said free end region of said flap.

20. A ski boot as recited in claim 19 wherein said tunnel shaped protuberance of said flap comprises an opening in said flap, opening toward said free end region, and limited by a flange, having an inside and an outside; said fastening element disposed at a distance from said flange on said upper; and said strap shaped tightening element guided into operative association with said fastening element by the outside of said flange.

* * * * *